United States Patent [19]

Brock

[11] 4,129,820

[45] Dec. 12, 1978

[54] VARIABLE REACTANCE TRANSFORMER

[75] Inventor: Elwood M. Brock, Bradenton, Fla.

[73] Assignee: Hunterdon Transformer Company, Flemington, N.J.

[21] Appl. No.: 838,185

[22] Filed: Sep. 30, 1977

[51] Int. Cl.[2] ..... H01F 21/08; G05F 1/32

[52] U.S. Cl. ..... 323/56; 323/89 C; 336/12; 336/155; 336/215

[58] Field of Search ..... 336/5, 10, 12, 155, 336/160, 180, 181, 170, 171, 215, 184; 323/6, 56, 89 C, 89 R

[56] References Cited

U.S. PATENT DOCUMENTS 3,505,588 4/1970 Brock ..... 323/56 X

*Primary Examiner*—Thomas J. Kozma

*Attorney, Agent, or Firm*—Jones, Tullar & Cooper

[57] ABSTRACT

An improved saturable reactance transformer having a main core and a pair of adjacent auxiliary cores is disclosed. The auxiliary cores carry DC control windings which regulate the reactance of the main core which carries the secondary, or output windings of the transformer. The primary winding is wound around all three cores, with the amplitude of the control voltage applied to the control windings regulating the output of the secondary windings. To prevent high voltage stresses in the transformer, each control winding is split into two or more windings, with the two windings being wound concentrically on their common core to reduce the voltage induced by the alternating current in the primary windings. In addition, the windings on the two auxiliary cores are cross-connected in pairs to equalize the reactance of each pair, thereby balancing the induced voltages. Finally, the transformer is physically constructed so that the start of the primary windings and the start of the control windings are at the same location so that the voltage difference between the finish of the control winding and the finish of the primary winding is subtractive rather than additive, thereby reducing the voltage stress imposed on the transformer insulation.

Three variable reactance transformers constructed in accordance with the foregoing are connected in a three phase configuration with their primary windings being delta-connected. The control windings of each transformer are connected to corresponding varible control sources to further reduce the induction of high stress voltages in the control windings by the primary alternating current.

6 Claims, 7 Drawing Figures

FIG. 1
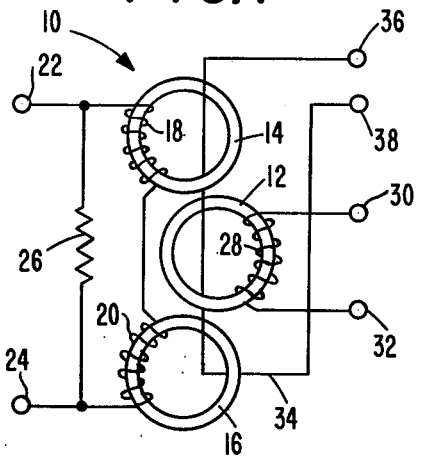
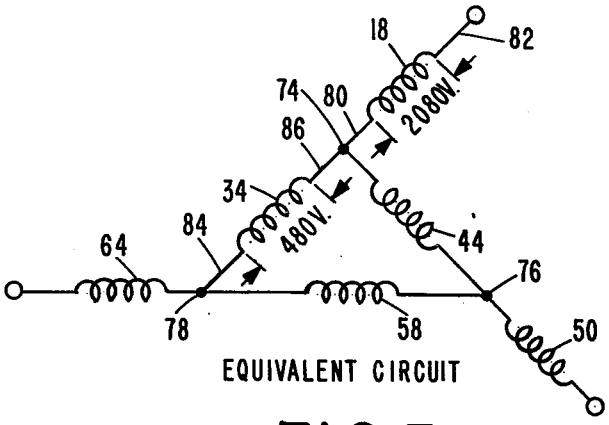
FIG. 3
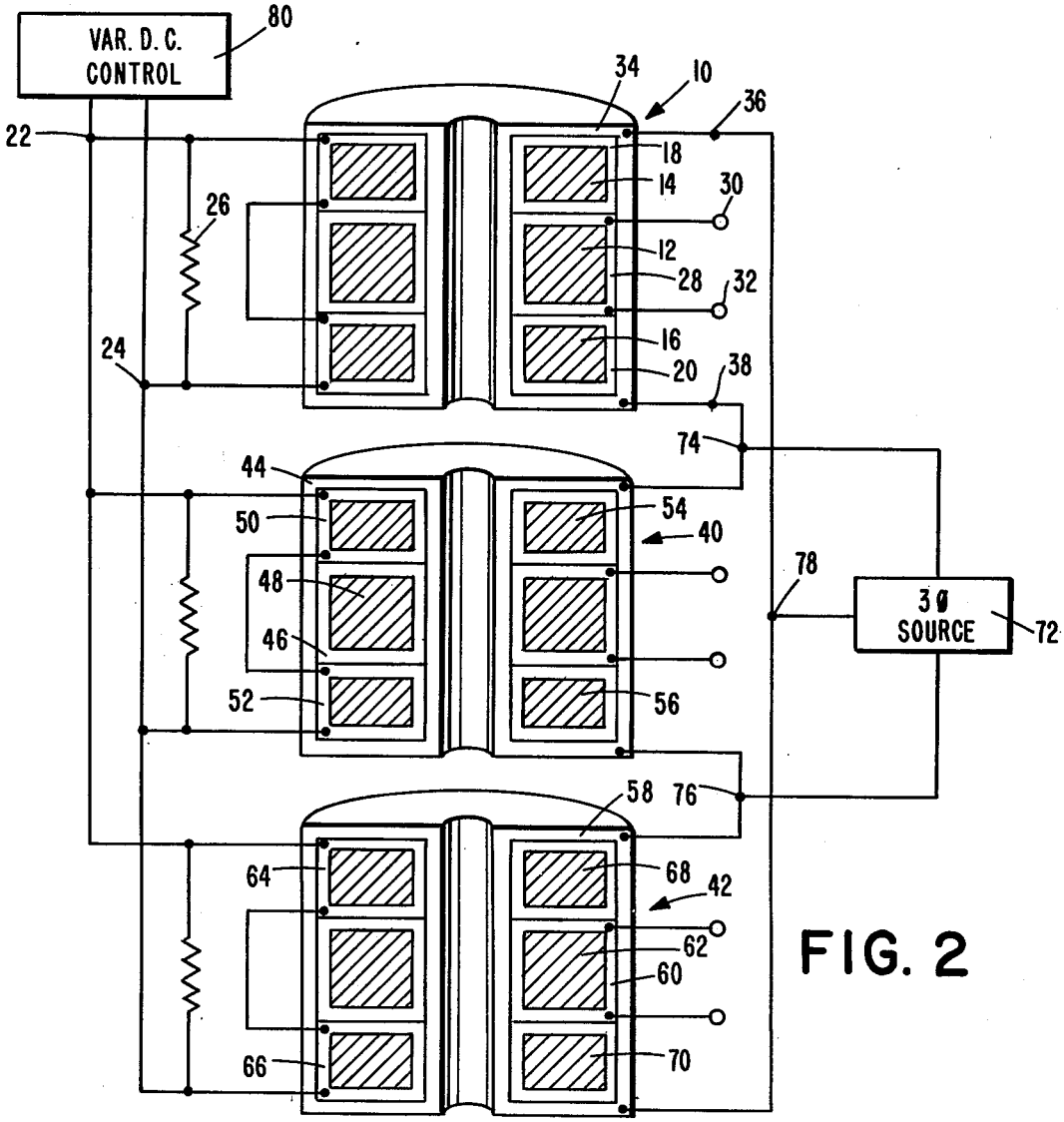
FIG. 2

IMPROVED VARIABLE REACTANCE TRANSFORMER

BACKGROUND OF THE INVENTION

The present invention relates, in general, to improved variable reactance transformers, and more particularly to a variable reactance transformer construction which permits use of the transformers in a three-phase delta configuration without stress failure.

Controllable transformers which utilize the saturating effects of direct current to derive a controllable output voltage and current have been known in the prior art, and one such transformer is disclosed in U.S. Pat. No. 3,343,074, issued Sept. 19, 1967 to Elwood M. Brock. In that patent a variable reactance transformer is shown as having three annular, concentrically arranged cores carrying control, primary and secondary windings formed as toroids on the cores. Each of the two outside or auxiliary cores carries a DC winding, the central or main core carries the secondary winding, while the primary winding encircles all three cores. The DC windings are connected in series with a variable source of direct current control power by which the saturation level of the control cores may be regulated. Variation of the state of saturation of the control cores presents a selectable reactance to the primary current, and thereby effects control of the output of the secondary winding. The two control windings are connected in series opposition to provide control on both halves of the alternating current in the primary winding.

The structure illustrated in U.S. Pat. No. 3,343,074 provides a variable transformer having an improved response time, an improved power factor and by substantially eliminating flux leakage, provides greater efficiency than was possible with prior art devices. Further, the reactor provides substantial savings in both material and labor to provide a considerable reduction in the costs of manufacture. The device produces efficient coupling and a very low reactance in its fully saturated condition, and provides an extremely high reactance in its unsaturated condition.

Although the transformer described in the foregoing patent has been found to be extremely satisfactory in most applications, and has met with considerable commercial success, it was found that when the unit was connected in a three-phase system of relatively high power, such as might be required in the operation of an electric furnace or similar load conditions, occasional failures of the transformers were experienced. Although these failures appeared, at first, to be random, it was found that in each case the failure involved a breakdown of the insulation between the control and primary windings in the transformers, and involved two of the three transformers in a three-phase system. A stress analysis of these units indicated that the breakdowns were being caused by very high voltages which exceeded by substantial margins the capabilities of the insulation being used. Such failures principally occurred when the DC control windings of the three transformers were connected externally in parallel to a single control source, and when the primaries of the transformers were connected together in a delta arrangement.

Even after a great deal of study and testing of the transformers, it still was not possible to pinpoint the cause of such failures. However, a careful analysis of the voltage equivalent circuits of the transformer suggested that the induction of alternating current from the primary into the control windings was causing the problem, and that the difficulty was compounded when the physical relationship of the control and primary windings was such that the beginning, or start, of one winding was adjacent the ending, or finish, of the other, with the physical relationship being such that the AC voltage induced across the DC winding was additive to the AC voltage across the primary winding. The stress produced by this additive voltage was found, upon analysis, to be greater than the insulation could handle, resulting in failure of the transformers. Such failures were calamitous, not only because the failures resulted in the total loss of two of the three transformers in each three-phase system in which they were installed, but because such failures resulted in shutdown of the system with resultant losses of material, losses of labor and time in replacing the transformers, and loss of business to the users.

One immediately apparent solution to the problem was to increase the insulation within the transformer to prevent such stress breakdown. However, an analysis of the voltage levels causing the stress failures indicated that in a transformer nominally designed to handle 480 volts AC it would have been necessary to provide insulation that would withstand over 9,800 volts in order to meet the standard NEMA requirements for insulation. These requirements are that the insulation to able to withstand twice the nominal voltage, plus 1,000. In this case, then, the nominal strenth requirement of the insulation would have been that it withstand 2 times 480 volts plus 1,000 volts, or 1,960 volts. Thus, it was apparent that a five fold increase in the insulation within the transformer would have been required to prevent the stress failures, and such an increase would have substantially eliminated the variable reactance transformer from consideration as a three-phase source in such systems, since that amount of insulation would have made it economically unfeasible as well as bulky, heavy, and difficult to manufacture and install.

SUMMARY OF THE INVENTION

In view of the foregoing, it was an object of the present invention to devise a transformer structure which would overcome the difficulties encountered with the prior transformer systems and would permit the use of variable reactance transformers in high load situations, particularly where connected in three-phase delta configurations.

It was a further object of the invention to provide a three-phase variable reactance transformer system wherein the primaries could be connected in delta configuration, and wherein the voltage stresses produced by the induction of alternating currents from the primary into the control windings would be maintained at a relatively low level so as to avoid the difficulties encountered in prior art configurations.

Briefly, the present invention overcomes the problems encountered with the prior art transformers through the combination and interaction of several changes in transformer structure, each of which might not solve the problem in and of itself, but all of which cooperate in a unique and unexpected manner to prevent the breakdowns experienced with prior art structures. A first modification of the prior devices includes dividing the control winding on each of the auxiliary cores into two or more separate winding sections, thereby reducing the AC voltage induced in each winding. The winding sections are wound on top of each other on their respective cores, the first section being wound adjacent the core and the second being wound on top of the first section, and so on, with the adjacent coils being in direct contact with each other, without insulation. Secondly, the winding sections on the auxiliary cores are cross-connected in pairs so that the inner winding on the first auxiliary core is connected in series opposition with the outer winding of the second auxiliary core to form a first pair. In similar fashion, a second pair is formed by the outer winding of the first auxiliary core being connected in series opposition with the inner winding of the second auxiliary core, and this cross-connection between inner and outer winding sections insures that the reactances of each pair of serially connected winding sections will be similar so that the voltage across each pair is of the same magnitude. Since the windings on the first auxiliary core are wound in opposition to those on the second core, this cross-connection results in a cancellation of the induced voltages in the control windings.

In order to prevent the alternating current which is induced in the control windings from being additive with the alternating current in the primary winding of that transformer, the unit is physically constructed so that the start of the two windings is at approximately the same circumferential location on the transformer unit, and extend out of the transformer housing at substantially the same spot, thereby insuring that the voltage difference between the finish of the control winding and the finish of the primary winding is subtractive rather than additive, thereby reducing the total voltage difference between the coils.

A final modification, which need not be used in every application, but which has been found to give improved results, is the provision of separate DC controllers for each of the three transformers in a three-phase system. Although separate controllers increase the cost of the system, they serve to prevent induced voltages from each transformer from being connected to the windings of an adjacent transformer where they would be additive to the voltages induced in that adjacent unit. Accordingly, the use of separate controllers reduces the risk of failure, while at the same time providing improved individual control of the output of each of the transformers in the three-phase system.

Through the use of the foregoing features, the voltage stresses in three-phase transformer systems utilizing saturable reactance transformers have been reduced by a factor of five, thereby effectively eliminating the failure problems encountered with prior structures without having to resort to increased insulation, and thus without incurring the corresponding increases in the cost of manufacture as well as in the weight and size of the transformers.

BRIEF DESCRIPTION OF THE DRAWINGS

The foregoing and additional objects, features and advantages of the present invention will become apparent from a consideration of the following detailed description of a preferred embodiment of the invention, taken in conjunction with the accompanying drawings, in which:

FIG. 1 is a schematic illustration of a conventional variable reactance transformer;

FIG. 2 is a partial schematic and partial diagrammatic illustration of the conventional use of variable reactance transformers in a three-phase delta connection;

FIG. 3 is an equivalent circuit illustration of the three-phase system of FIG. 2;

DESCRIPTION OF A PREFERRED EMBODIMENT

Figure 4:
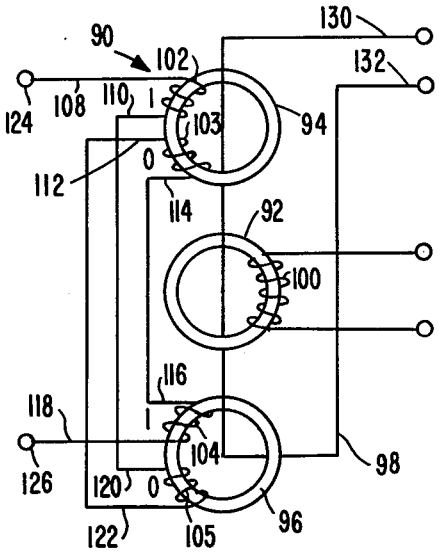
FIG. 4 is a schematic illustration of an improved variable reactance transformer in accordance with the present invention.
Figure 5:
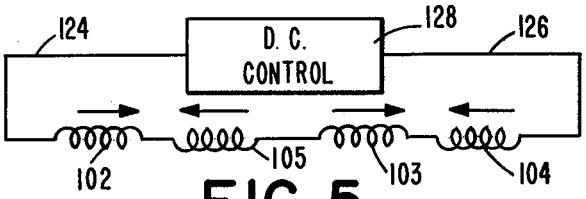
FIG. 5 is a schematic illustration of the control windings of the reactor of FIG. 4.

Turning now to a more detailed consideration of the present invention, there is illustrated in FIG. 1 a variable reactance transformer comprising a main core 12 and two auxiliary cores 14 and 16. These cores are annular in shape and are constructed of a suitable magnetic material, the cores being so proportioned that the auxiliary cores 14 and 16 may become saturated when under the influence of a normal range of DC control current. Neither the auxiliary cores nor the main core necessarily exhibit the so-called "square-loop hysteresis curves" but preferably are of conventional magnetic material.

Auxiliary cores 14 and 16 carry control windings 18 and 20, respectively, connected in series opposition across a variable source of DC control current connected at terminals 22 and 24. The series arrangement of control windings is shunted by a suitable impedance such as resistor 26. The main core 12 carries a secondary winding 28 which provides the controlled output voltage across terminals 30 and 32. A primary winding 34 surrounds all three cores 12, 14 and 16, as well as the control and secondary windings carried thereon, and is connected at input terminals 36 and 38 to a source of alternating current.

As set forth in greater detail in U.S. Pat. No. 3,343,074, and as illustrated in FIG. 2, transformer 10 is constructed by sandwiching the main core 12 between the auxiliary cores 14 and 16, the cores being as closely adjacent one another as the bulk of the windings will permit. The control windings 18 and 20 are wound only on the auxiliary cores, the secondary winding is only on the main core 12, and the primary winding is inductively coupled to all three cores. The cores are annular in shape and the windings are toroidal, with the cores being coaxial and the axes of the winding toroids also being coaxial. The application of a DC control voltage to the control windings produces a controlled amount of magnetic flux in the auxiliary cores to vary the reactance of the primary winding. This in turn varies the effect of the primary current and controls the energy available for driving the secondary winding so that the output of the secondary winding is controlled easily and quickly merely by varying the DC control source.

In FIG. 2, the transformer 10 is shown connected in a three-phase system with similar transformers 40 and 42. Trnasformer 40 includes a primary winding 44, a secondary winding 46 wound on a main core 48, and a pair of control windings 50 and 52 wound on auxiliary cores 54 and 56. Transformer 42 incorporates a primary winding 58, a secondary winding 60 wound on a main core 62, and a pair of control windings 64 and 66 wound on auxiliary cores 68 and 70. The primary windings 34, 44 and 58 are connected in delta configuration, with a three-phase alternating current source 72 being connected to the junctions 74, 76 and 78 of the delta configuration, whereby one phase of the source is connected across each of the primary windings in known fashion.

The control windings 18 and 20 are connected across a source of variable direct current 80, with the windings 50 and 52 of transformer 40 being similarly connected in series opposition to each other and connected across source 80. In addition, the control windings 64 and 66 of transformer 42 are connected in series opposition and the series arrangement is connected across the control source 80 so that the control windings of each transformer are connected in parallel with the control windings of the other transformers.

When a three-phase transformer system was constructed in accordance with FIG. 2, it was found that the interconnected primary windings, together with the parallel connection of the control windings, produced extremely high voltage stresses within each transformer, for the primary windings served to induce alternating current into the control windings, and the current so induced in one transformer could be added to the current induced in another transformer. Even though the control windings on a given transformer were connected in series opposition, the connections between adjacent transformers resulted in very high voltages across the control winding terminals which, when added to the voltages appearing across the primary windings, resulted in voltage differences between the primary and secondary winding terminals which exceeded the insulation capabilities of the transformer, even though the transformers were constructed in accordance with usual industry standards, with due regard to safety margins.

The result of this interaction is illustrated in the equivalent circuit diagram of FIG. 3 wherein the three primary windings 34, 44 and 58 are shown in delta configuration joined at their ends by junction points 74, 76 and 78. The effect of the induced currents in the various control windings was to produce instantaneous voltages which were equivalent to adding the voltages appearing across the control windings in series with the voltages appearing across their corresponding primary windings in the manner illustrated in FIG. 3. As an example of the voltage stresses produced by this effect, a typical primary winding 34 may contain 30 turns, and if the source 72 provides 480 volts across the primary winding, then the primary winding would carry 16 volts per turn and would produce a corresponding flux in the auxiliary cores. If the control windings on each core included 260 turns, which would be typical for this type of transformer, and assuming that the core cross-sections are such that the auxiliary cores carry one-half of the flux generated by the primary winding, the instantaneous voltage across the control windings would reach $(16 \times 260)/2 = 2080$ volts. This voltage would appear as an instantaneous value first across one of the control windings and then across the other in the course of a single cycle of the alternating current source, and represents the instanteous potential difference between the start, or lead end 80 of the winding and the finish or output end 82 of the winding.

The primary winding carries 480 volts between its starting end 84 and its furnishing end 86, so if the windings are so oriented in the construction of the transformer that the starting end 80 of the control wining 18 is located physically adjacent the finish end 86 of the primary winding 34, then the total voltage across windings 34 and 18 between junction point 78 and the finish end 82 of coil 18 could reach as high as 2,560 volts. When it is considered that the NEMA standards for the industry require a design insulation value of two times the nominal voltages, plus 1,000 (2V + 1000), it will be seen that the insulation in transformer 10, for example, would have to be designed for a voltage of at least 6,180 volts, as opposed to the nominal design value of 2 times 480 plus 1,000, or 1,960.

Upon analysis of the three-phase configuration, therefore, it was found that the actual voltage induced in the control windings, when added to the voltage across the primary windings resulted in an actual value which exceeded by three times the design insulation value for the transformer. Further, when the phase relationships between the three transformers, as well as the interconnection of the various windings were taken into account, it was found that in some cases the voltages between the terminals of various windings could reach as high as 4428 volts which, under the NEMA formula, required an insulation rating of 9856 volts. Thus, it was found that in some circumstances, the instantaneous voltages exceeded the design value five fold, particularly between windings of adjacent transformers. The high voltage stresses found to occur in these transformers exceeded their insulation capabilities by such a great amount, that massive failures occurred when they were connected in the three-phase configuration, and it was found that usually two of the three transformers would fail at the same time.

To avoid the foregoing problem of failure encountered in the prior art, without the necessity of large increases in the amount of insulation used in the transformers, the transformer units of the prior art were modified in the manner illustrated in FIGS. 4 to 7, to which reference is now made. As shown in schematic form in FIG. 4, the control windings for the transformer are split into two or more pairs to reduce the total voltage induced in a given winding. Thus, the variable reactance transformer 90 incorporates a main core 92 and a pair of coaxial auxiliary cores 94 and 96, the cores carrying the primary and secondary windings 98 and 100 in the manner previously described. However, in accordance with the invention, the control windings are each divided into two parts, auxiliary core 94 carrying control windings 102, 103 and auxiliary core 96 carrying auxiliary windings 104, 105. In the preferred form, these windings are so constructed that one of the windings is wrapped around the core, and the second is wrapped around the outside of the first winding, also around the core. Thus, for example, winding 102 may be wrapped around and suitably insulated from auxiliary core 94 in the manner illustrated in FIG. 6 while the second winding 103 is wound around the outside of the first winding. Both windings are toroidal in shape and thus surround the annular core 94. The turns of the outer winding 103 may be wound directly on the outside of the coils of winding 102, without insulation separating the two windings. In similar manner, winding 104 on auxiliary core 96 may be wrapped around and be located adjacent to, but insulated from the core to form an inner winding, while winding 105 is wrapped in toroidal fashion around the outside of winding 104. Again, the outer winding 105 need not be insulated from the turns of winding 104.

In forming the windings 102 through 105, suitable input and output leads are provided at the start and the finish of each winding by means of which the coils may be interconnected. In placing winding 102 on the core, then, an input lead 108 is provided at the start of the coil, the winding wire is wound in toroidal fashion completely around the core and is terminated in output lead 110. This winding need not be wrapped so tightly around the core that the winding is immovable, for in this type of transformer, all of the windings preferably are imbedded in a suitable epoxy to form a rigid mass which holds the windings and the core laminations in place after the windings are properly located on the cores. Thus, in the process of forming winding 102, the winding may be left sufficiently loose on the core that it will slide on the core, allowing its position to be adjusted so that the physical location of the input and output leads 108 and 110, and thus of the start and finish of the winding, may be selected with respect to the input and output leads, and terminals of other windings to reduce the voltage stresses developed in the transformer. After completion of winding 102, the second control winding 103 is wound on core 94, starting with an input lead 112 and extending around the core in toroidal fashion on top of the winding 102. Again, the coil terminates in an output lead 114, with the input and output leads of the two windings being located adjacent each other so they will be at the same AC instantaneous potential, as illustrated in the same equivalent circuit of FIG. 7.

In similar fashion, inner winding 104 having input and output leads 116 and 118, respectively, at its start and finish is positioned on core 96 and the outer winding 105 with its input and output leads 120 and 122 is wound about winding 104. Again the input leads 116 and 120 are adjacent each other, as are the output leads 118 and 122, to insure that these leads carry the same AC instantaneous potential, in the manner illustrated in FIG. 7, but for the opposite half cycle of AC.

The transformer is assembled in the conventional manner with the primary and secondary windings 98 and 100, but the control windings 102 to 105 are cross connected so that the inner winding on one core is connected in series with the outer winding of the other core, and vice versa, the windings of the two auxiliary cores being in series opposition. Thus, for example, the output lead 110 of winding 102 is connected to the input lead 120 of winding 105; the output lead 122 of winding 105 is connected to the input lead 112 of winding 103; and the output lead 114 of outer winding 103 is connected to the input lead 116 of winding 104. The remaining leads 108 and 118 are then connected to suitable start and finish leads 124 and 126 by which the control windings are externally connected to a source of DC control current 128, illustrated in FIG. 5. As illustrated in that figure, this interconnection of the several windings provides a series circuit arrangement wherein the flux induced in the pairs of windings for any given cycle of the AC primary source will be in series opposition to produce cancelling voltages. Further, because each control winding has been split, the maximum instantaneous voltage or any imbalance voltage that can appear across any given winding by reason of the differences bewteen the construction of the windings, is reduced by one-half.

Figure 6:
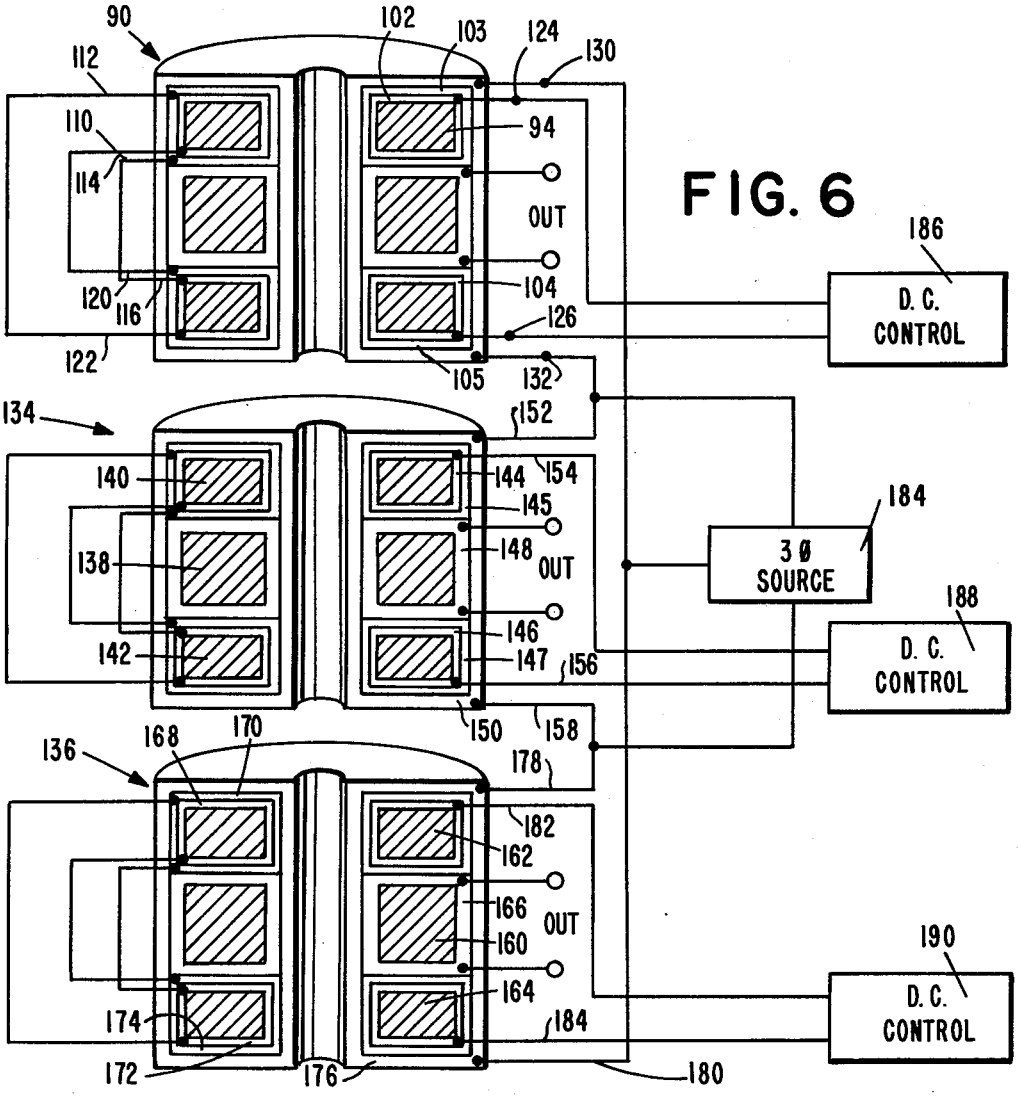
FIG. 6 is a partial schematic and partial diagrammatic illustration of three reactors constructed in accordance with the invention and connected in a three-phase delta system.

In constructing the transformer 90, particularly for use in three-phase delta systems of the type illustrated in FIG. 6, voltage stress problems are further reduced by careful adjustment of the physical location of the input and output leads for each of the control windings and of the start and finish leads 124 and 126. This is accomplished by rotating the auxiliary cores 94 and 96 with respect to the main core 92, or by shifting the position of the coils on these auxiliary cores, so that the physical location of the start lead 124, which provides the input to the control windings, is physically located adjacent the starting end 130 of the primary winding 98, and spaced from the finish end 126 of the control winding, in the manner diagrammatically illustrated in FIG. 6. Since the polarity of the instantaneous flux in the primary winding and in the control windings are the same, the starting end of the primary and the starting end of the control winding will be at the same polarity with this arrangement. Similarly, the polarities of the finish leads will be the same, and this will minimize the voltage difference between the finish ends of these windings. In fact, it has been found that with such a physical arrangement, the voltages across the primary and the control windings are no longer additive, but are subtractive so that, with the unitary control winding in the example given above the 480 volts across the primary winding would be subtracted from the 2080 volts across the control windings, thereby producing a voltage difference between the finish end 126 of the control winding and the finish end of the primary winding of 1600 volts, instead of the 2560 volts in the prior configuration. With the control winding split so that the voltage across each winding on the auxiliary core is reduced by one-half, the voltage differential at the finish ends of the winding is reduced to (2080/2) − 480, or 560 volts, a value well within the insulation capabilities of the transformer unit.

Figure 7:
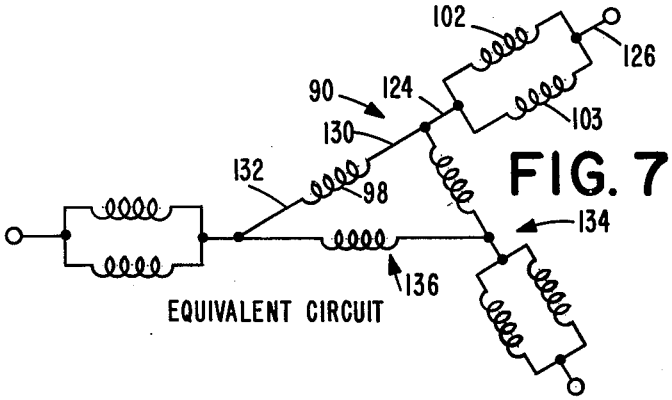
FIG. 7 is an equivalent circuit illustration of the three-phase system of FIG. 6.

The foregoing is illustrated in the equivalent voltage circuit diagram of FIG. 7 wherein the instantaneous relationship of the various windings for one-half of their applied alternating current cycle is illustrated. In this arrangement, the starting end 130 of the primary winding 98 is adjacent the starting lead 124 of the control windings. The two windings 102 and 103 which are wound on core 94 each have the same voltage induced by the primary winding so that their starting ends 108 and 112 will both have the same instantaneous voltage and polarity. Similarly, their finish ends 110 and 114 will be at the same instantaneous values, and thus they may be illustrated in FIG. 7 as being connected in parallel between their input and output leads 124 and 126. Further, the voltage relationships between the primary and the control windings are such that the two starting leads 130 and 124 may be shown as connected in series, since points 124 and 130 are at the same instantaneous polarity and voltage. From this illustration it may be seen that the voltage difference bewteen the finish lead 126 of the control windings and the finish lead 132 of the primary windings is subtractive, and thus considerably reduced from the values obtained in the configuration illustrated in FIG. 3. It will be apparent that on the second half-cycle of the AC source, the equivalent circuit would show the windings 104 and 105 in series with the primary windings.

Referring again to FIG. 6, it will be seen that the transformer 90 is connected in delta arrangement with similar transformers 134 and 136, each of which is constructed in accordance with the foregoing discussion. Thus, transformer 134 includes main and auxiliary cores 138, 140 and 142, respectively, the auxiliary cores carrying inner and outer control windings 144 and 145, and 146 and 147, respectively, while the main core 138 carries secondary winding 148. Surrounding the three cores is the primary winding 150, the starting end 152 of which is positioned adjacent the starting end 154 of the control windings. Also as illustrated, the finish end 156 of the control winding is located adjacent the finish end 158 of the primary winding, but the voltage difference between the two is not sufficient to cause a stress breakdown of the insulation at that point, because of the close physical location and equal polarity and potential of the starting ends of the windings.

Again, transformer 136 includes a main core 160 and auxiliary cores 162 and 164, the main core carrying a secondary winding 166 and the auxiliary cores carrying inner and outer windings 168, 170 and 172, 174, respectively. The cores and the secondary and control windings are surrounded by a primary winding 176, having start and finish leads 178 and 180, respectively. The control windings have start and finish leads 182 and 184 which are located physically adjacent the start and finish leads of the primary winding, for the reasons discussed above.

As in the configuration of FIG. 3, a three-phase source 184 is connected to the junctions of the delta-connected primary windings, but in distinction from the prior arrangement, the construction of FIG. 6 utilizes three separate DC control sources 186, 188 and 190 each connected across the start and finish leads of the control windings for corresponding transformers 90, 134 and 136. The use of three separate DC supply voltages further improves the operation of the system of FIG. 6 and insures that the voltage stresses in the three transformers will be held at a low value when the system is connected in the delta configuration. This occurs because with the separate controls, the control windings are not connected in parallel, and induced voltages in one transformer are not supplied by way of this interconnection to the other transformers in the system. Rather, the induced AC voltages in the control windings appear across the power supply transformers of their corresponding DC control units. Although this configuration requires two extra DC controllers, the resulting reduction in insulation requirements compensates for this cost and, furthermore, permits separate adjustment of each transformer to compensate for load variations between the three units. Such variations are common in furnace applications, and this arrangement of separate controls facilitates maintenance of uniform temperatures within the furnace, thereby providing an added advantage.

Although the present invention has been disclosed in terms of a transformer having auxiliary cores arranged above and below the main transformer core, it will be apparent that other arrangements, such as those illustrated in the aforementioned U.S. Pat. No. 3,343,074, and others, may be used while still practicing the present invention. Additional variations and modifications will become apparent to persons of ordinary skill in the art, and accordingly it is intended that the present invention not be limited by the foregoing description, which is the presently preferred embodiment of the invention, but that the invention only be limited by the following claims.

What is claimed is:

1. An improved saturable reactance transformer comprising:

an annular main core;

first and second auxiliary cores adjacent and coaxial with said main core;

first and second toroidal control windings on each of said auxiliary cores, the first control winding being toroidally wound on and electrically insulated from its core and the second control winding being toroidally wound over said first control winding;

a secondary winding toroidally wound only on said main core;

a primary winding having a first start lead and a first finish lead, said winding being toroidally wound over said main and auxiliary cores and their respective secondary and control windings; and means cross-connecting said control windings in series opposition between a second start lead and a second finish lead; said windings and cross-connections being so arranged that said first and second start leads are physically adjacent each other and said first and second finish leads are physically adjacent each other, whereby the instantaneous AC voltage induced in said control windings by alternating current applied to said primary windings and the AC voltage across said primary windings are subtractive.

2. The transformer of claim 1, wherein said means cross-connecting said control windings includes means connecting said first control winding on said first auxiliary core in series opposition with said second control winding on said second auxiliary core, and vice versa.

3. The transformer of claim 1, wherein said second control winding on each auxiliary core is wound in direct contact with its corresponding first control winding.

4. An improved three-phase saturable reactance transformer having first, second and third transformer units connected in delta configuration, each said transformer unit comprising:

an annular main core;

first and second auxiliary cores adjacent and coaxial with said main core;

first and second toroidal control windings on each of said auxiliary cores, the first control winding being toroidally wound on and electrically insulated from its core and the second control winding being toroidally wound over said first control winding;

a secondary winding toroidally wound only on said main core;

a primary winding having a first start lead and a first finish lead, said winding being toroidally wound over said main and auxiliary cores and their respective secondary and control windings; and means cross-connecting said control windings in series opposition between a second start lead and a second finish lead; and windings and cross-connections being so arranged that said first and second start leads are physically adjacent each other and said first and second finish leads are physically adjacent each other, whereby the instantaneous AC voltage induced in said control windings by alternating current applied to said primary windings and the AC voltage across said primary windings are subtractive.

5. The three-phase transformer of claim 4, further including:

means connecting the primary windings of each of said transformer units in delta configuration wherein the start lead of the primary winding of one transformer unit is connected at a junction to the finish lead of the primary winding of the next adjacent transformer unit; and means for connecting said junctions of said primary windings to a source of three-phase alternating current.

6. The three-phase transformer of claim 5, further including a separate source of variable DC control voltage for each of said transformer units, said control voltage being connected between the start and finish leads of the control windings for its corresponding transformer unit.

* * * * *

UNITED STATES PATENT AND TRADEMARK OFFICE

CERTIFICATE OF CORRECTION

PATENT NO. : 4,129,820

DATED : December 12, 1978

INVENTOR(S) : Elwood M. Brock

It is certified that error appears in the above-identified patent and that said Letters Patent are hereby corrected as shown below:

Claim 4, line 21, the word "and", first occurrence, should read --said--.

Signed and Sealed this

*Eleventh* Day of *March 1980*

[SEAL]

*Attest:*

SIDNEY A. DIAMOND

*Attesting Officer*

*Commissioner of Patents and Trademarks*